US006419324B1

(12) United States Patent
Kennedy et al.

(10) Patent No.: US 6,419,324 B1
(45) **Date of Patent: *Jul. 16, 2002**

(54) METHOD OF SEALING OFF A MINE PASSAGEWAY

(75) Inventors: William R. Kennedy; John M. Kennedy, both of Taylorville, IL (US)

(73) Assignee: Jack Kennedy Metal Products & Buildings, Inc., Taylorville, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 313 days.

(21) Appl. No.: 09/044,455

(22) Filed: Mar. 19, 1998

(51) Int. Cl.[7] ..... E21F 1/14

(52) U.S. Cl. ..... 299/12; 405/151; 405/150.2; 454/169

(58) Field of Search ..... 299/12; 405/132, 405/150.1, 150.2, 151; 454/169

(56) References Cited

U.S. PATENT DOCUMENTS 4,478,535 A * 10/1984 Kennedy et al. ..... 405/132
4,483,642 A * 11/1984 Kennedy et al. ..... 405/132
4,484,837 A * 11/1984 Kennedy et al. ..... 405/132
4,547,094 A * 10/1985 Kennedy et al. ..... 405/132
4,695,035 A * 9/1987 Kennedy et al. ..... 254/93 R
RE32,675 E * 5/1988 Kennedy et al. ..... 405/132
RE32,871 E * 2/1989 Kennedy et al. ..... 405/132
4,820,081 A * 4/1989 Kennedy et al. ..... 405/132
5,167,474 A * 12/1992 Kennedy et al. ..... 405/132
5,462,204 A * 10/1995 Finn ..... 222/137

* cited by examiner

*Primary Examiner*—David Bagnell
*Assistant Examiner*—Sunil Singh
(74) *Attorney, Agent, or Firm*—Senniger, Powers, Leavitt & Roedel

(57) ABSTRACT

A method of sealing off a mine passageway. The method involves installing a plurality of vertical panels side by side across the passageway to form a stopping. The stopping has gaps between adjacent panels and gaps between the panels and adjacent mine surfaces defining the mine passageway. The method further comprises holding an injector in or closely adjacent the gaps, and injecting a fluent sealing material under pressure into the gaps to form a seal.

15 Claims, 5 Drawing Sheets

METHOD OF SEALING OFF A MINE PASSAGEWAY

BACKGROUND OF THE INVENTION

This invention relates generally to mine stoppings and, more particularly, to a method of sealing off a mine passageway.

So-called "stoppings" are widely used in mines to stop off the flow of air in passages in the mines, a "stopping" generally being a masonry (e.g., concrete block) or metal wall installed at the entrance of a passage to block flow of air therethrough. This invention relates especially, albeit not exclusively, to the type of metal mine stopping shown for example in U.S. Pat. No. 4,483,642 (Re. 32,675) comprising a plurality of elongate extensible panels extending vertically in side-by-side relation from the floor to the roof of a mine passageway across the width of the passageway. After the panels are installed, there are gaps between the panels and between the panels and adjacent surfaces of the mine (i.e., the floor, the roof and the ribs defining opposite sides of the passageway). These gaps are typically sealed in a number of ways, as by spraying a foam, such as a polyurethane foam, on the stopping and around the stopping. However, when there is shifting and heaving of the mine in the vicinity of the passageway (sometimes referred to as a "mine convergence"), sprayed-on foams tend to buckle away from the surfaces, exposing cracks. Cementitious sealants are also used, but a mine convergence often causes the sealant to pop off the surfaces. More flexible sealants are sometimes used as well, but these are easily torn by relative movement of the panels, and they add no strength to the stopping.

SUMMARY OF THE INVENTION

Among the several objects of this invention may be noted the provision of an improved method for sealing off a mine passageway; the provision of such a method which has particular (but not exclusive) use in connection with a stopping constructed of a series of vertical side-by-side panels extending across the passage; the provision of such a method which provides a seal which will withstand mine convergences; the provision of such a method which provides a seal which increases the structural strength of the mine stopping; the provision of such a method which uses less sealing material for lower cost; and the provision of such a method which is safe to carry out.

In general, a method of the present invention comprises installing a plurality of vertical panels side by side across a mine passage to form a stopping. The stopping has gaps between adjacent panels and gaps between the panels and adjacent mine surfaces defining the mine passage. The method further comprises holding an injector in or closely adjacent the gaps, and injecting a fluent sealing material under pressure into the gaps to form a seal.

Another aspect of this invention involves sealing a stopping already installed in a mine passageway, the stopping having gaps therein and gaps between the stopping and adjacent mine surfaces defining the mine passageway. The method comprises holding an injector in or closely adjacent the gaps, and injecting a fluent sealing material under pressure into the gaps to form a seal.

Other objects and features will be in part apparent and in part pointed hereinafter.

BRIEF DESCRIPTION OF THE DRAWINGS

Corresponding parts are designated by corresponding reference numbers throughout the several views of the drawings.

DETAILED DESCRIPTION OF THE PREFERRED EMBODIMENT

Figure 1:
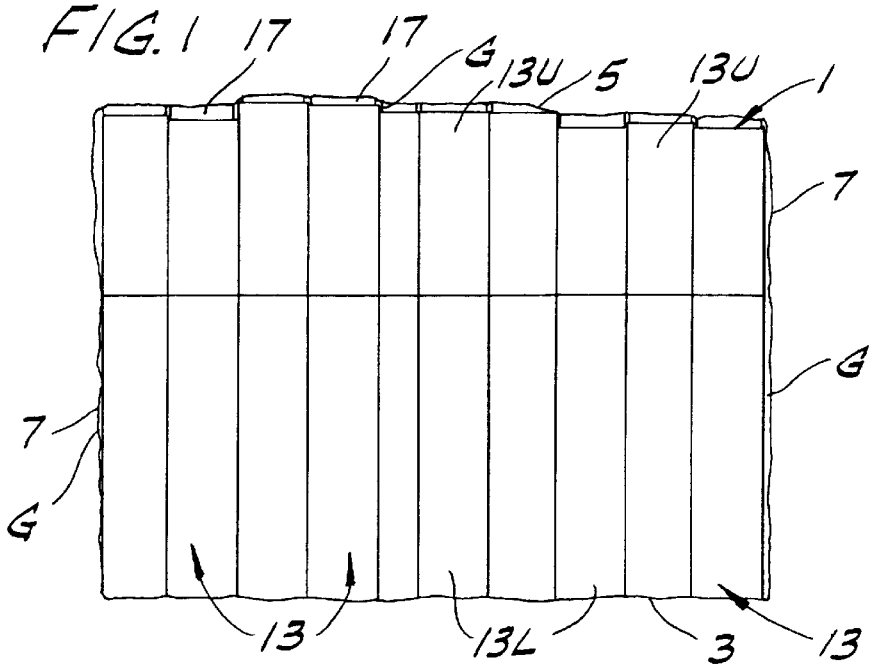
FIG. 1 is a front elevation of a mine stopping installed in a passageway before a sealing operation of the present invention has been carried out.
Figure 2:
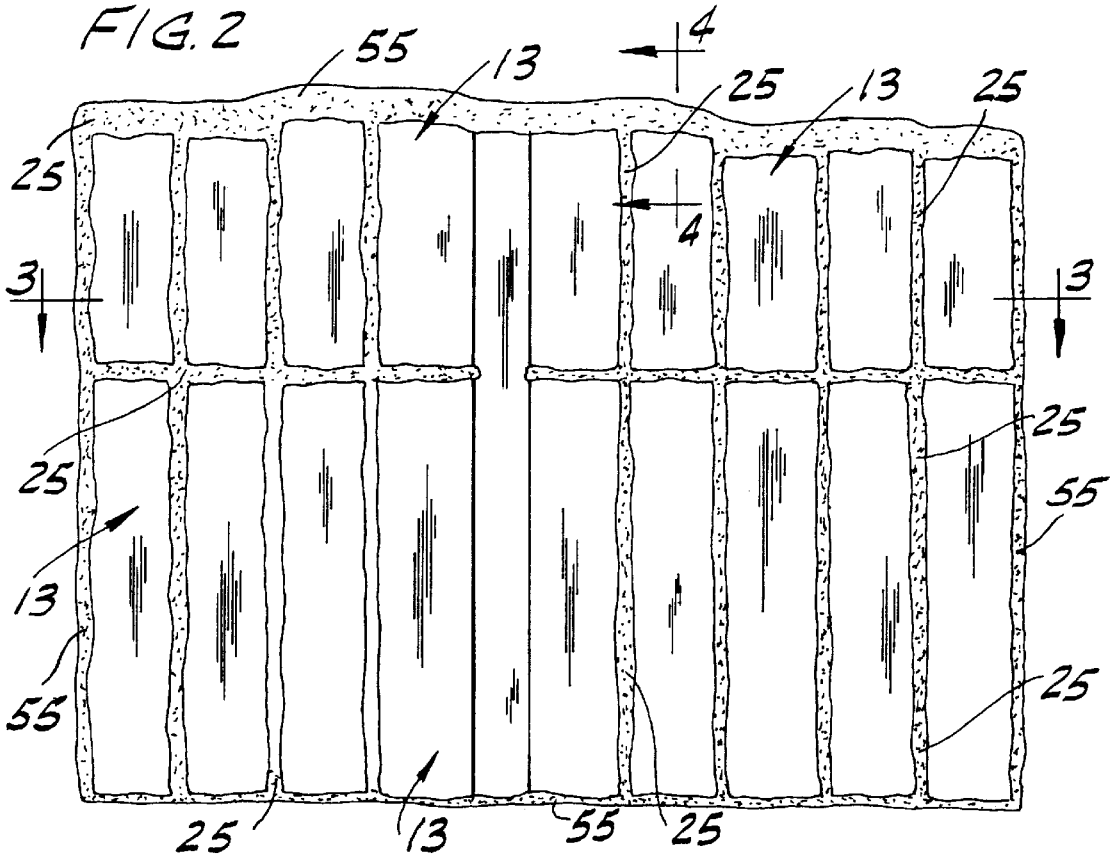
FIG. 2 is a view similar to FIG. 1 showing the mine stopping after it has been sealed.
Figure 3:
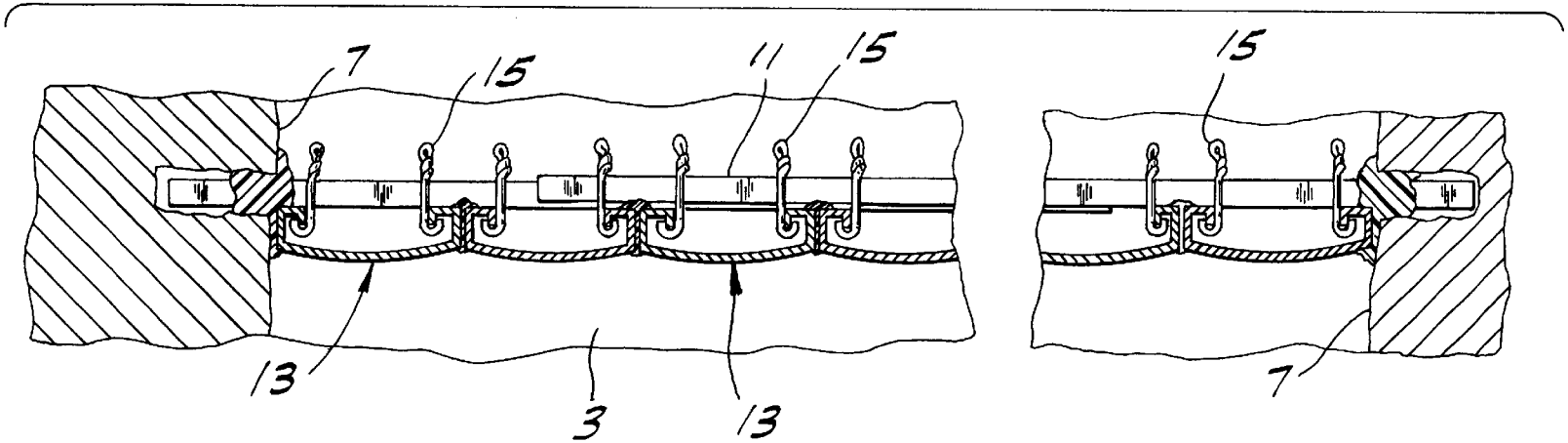
FIG. 3 is an enlarged horizontal section taken on line 3—3 of FIG. 2.

Referring now to FIGS. 1–4, there is generally indicated at 1 a mine stopping installed in a passageway P in a mine having a floor 3, a roof 5 and opposite sides 7 (ribs). The stopping 1 comprises bars 11 which extend substantially horizontally between the ribs 7 at opposite sides of the passageway, and a plurality of elongate extensible panels 13 which extend vertically in side-by-side relation from the floor 3 to the roof 5 of the passageway, and substantially across the entire width of the passageway. A plurality of wire ties 15 are provided to secure the panels to the bars. As explained in detail in U.S. Pat. No. 4,483,642, incorporated herein by reference, each of the extensible panels 13 comprises upper and lower telescoping elongate panel members 13U and 13L, and a sealing member 17 at the upper end of the panel for sealing against the roof of the passageway when the panel is extended (see FIG. 4.) One such sealing member 17 is fully described in U.S. Pat. No. 4,820,081, which is also incorporated herein by reference. (The panels 13 may be used without the sealing members 17.)

The panels 13 are installed in the passageway in the manner described in the aforementioned U.S. Pat. No. 4,483,642. A jack may be used to extend the panels to bring their upper and lower ends into pressure engagement with the roof 5 and floor 3 of the passageway, as described in U.S. Pat. No. 4,695,035, incorporated herein by reference. Side extensions (not shown) of the type described in U.S. Pat. No. 4,547,094 (Re 32,871), also incorporated herein by reference, may be used to block any space at a side of the passageway due to the irregularity of the rib 7. In any case, after the panels 13 are installed, the stopping 1 has gaps G therein between adjacent panels. There are also gaps G between the panels 13 and adjacent mine surfaces defining the mine passageway, such as the floor 3, roof 5 and/or ribs 7 of the passageway. These gaps should be closed to make the stopping substantially air-tight.

The method of the present invention is effective for sealing the aforementioned gaps G. This is accomplished by injecting a fluent sealing material 25 into the gaps to form a seal. Preferably, this sealing material 25 is an expansible material (e.g., a foaming fluid) which is injected before the fluid has reached a fully expanded state so that the material penetrates into the gaps G and then expands against adjacent panel surfaces and adjacent mine surfaces to form the aforementioned seal. It is important that the sealing material 25 actually penetrate into the gap to at least partially fill it, and not merely overlay (bridge) the gap. The pressure at which the sealing material is injected should be sufficient to achieve such penetration.

Figure 8:
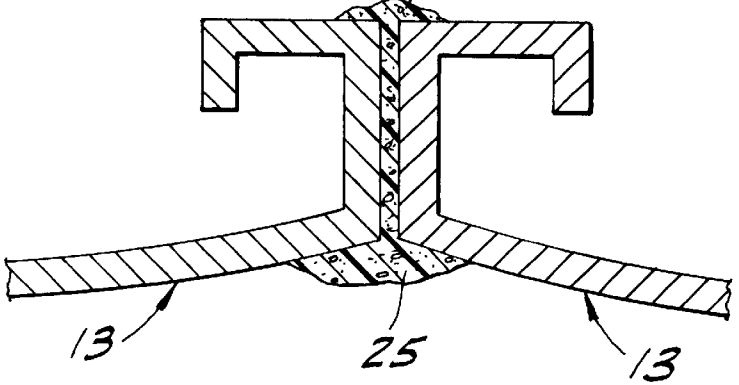
FIG. 8 is a view similar to FIG. 7 showing the sealing material after it has set to seal the gap.
Figure 7:
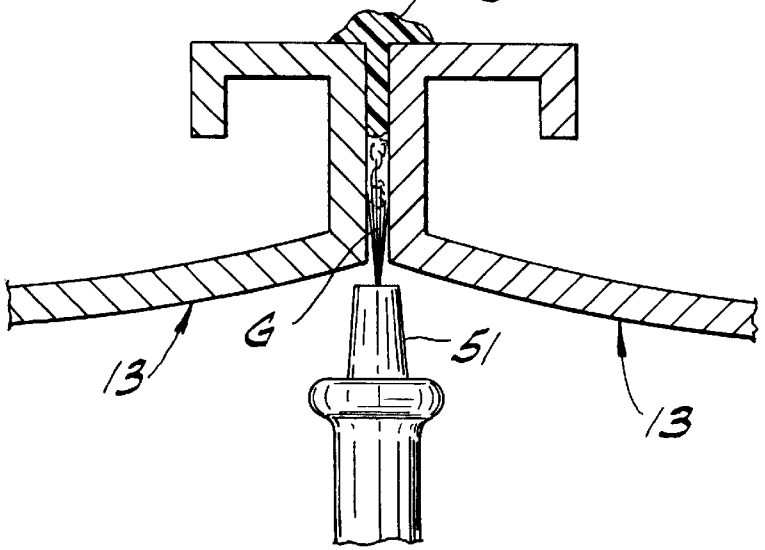
FIG. 7 is a top plan view showing the injector injecting sealing material into a gap to be sealed.
Figure 4:
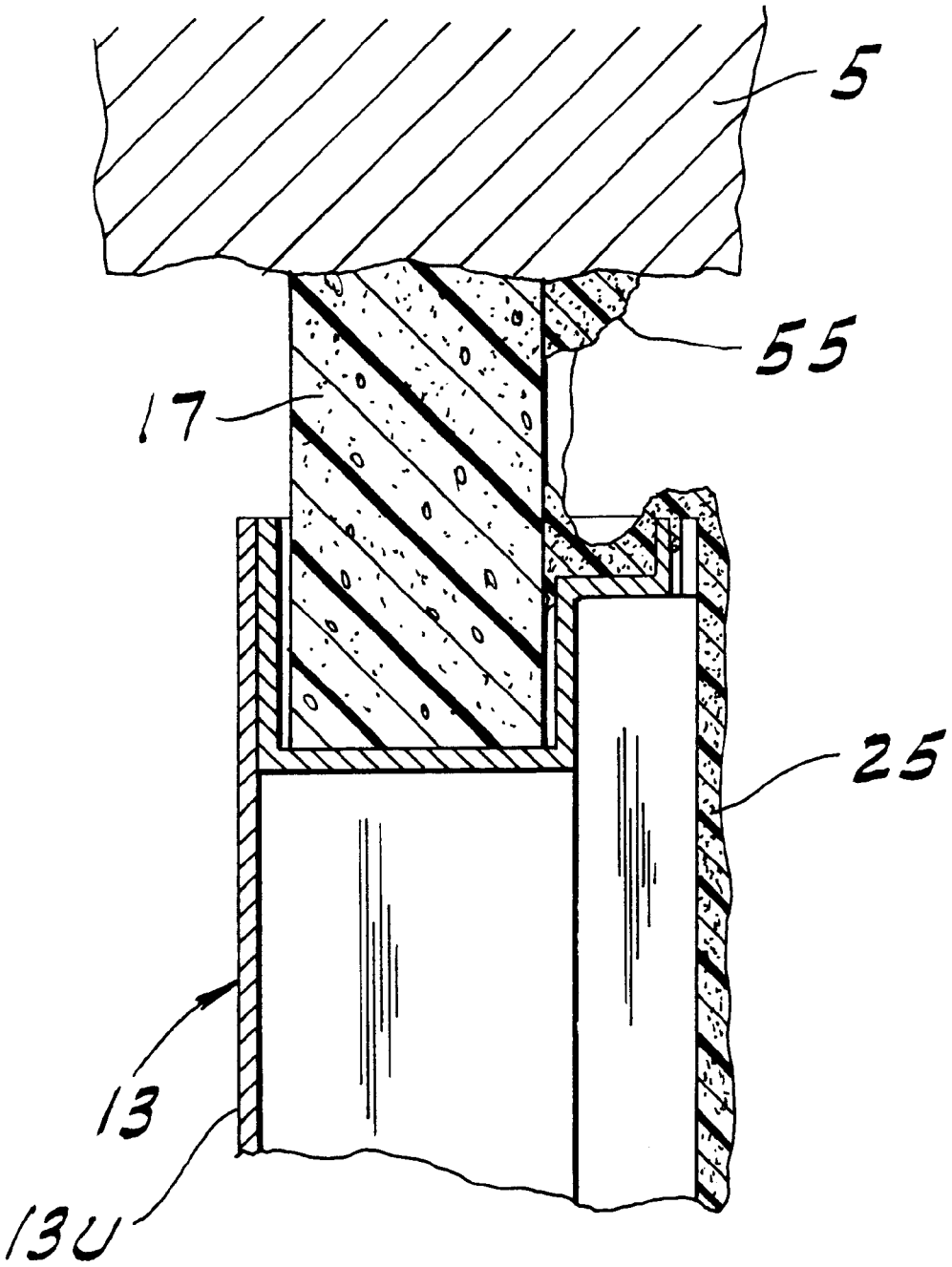
FIG. 4 is an vertical enlarged section on line 4—4 of FIG. 2.
Figure 5:
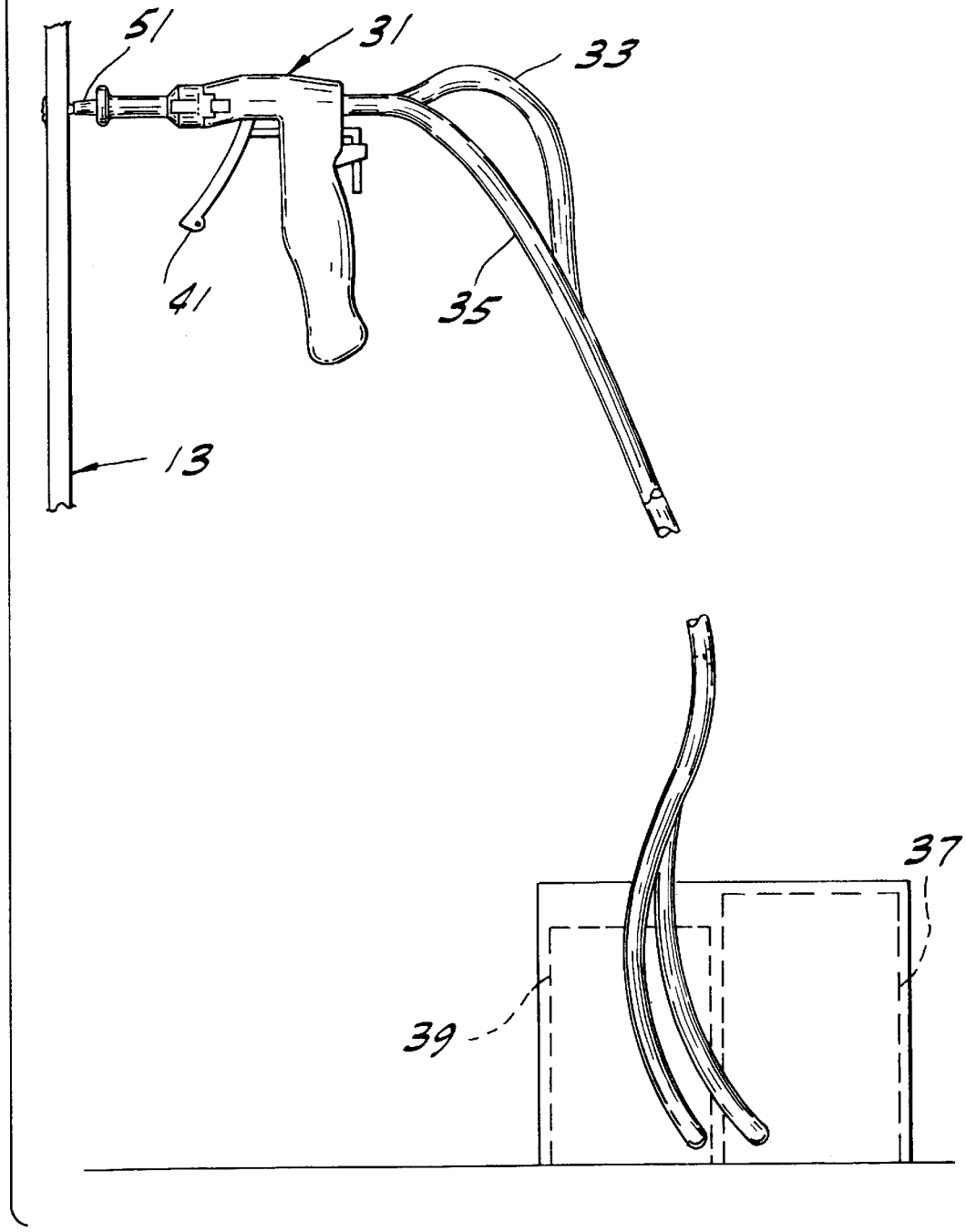
FIG. 5 is a side view showing an injector and associated apparatus for use in the method of this invention.
Figure 6:
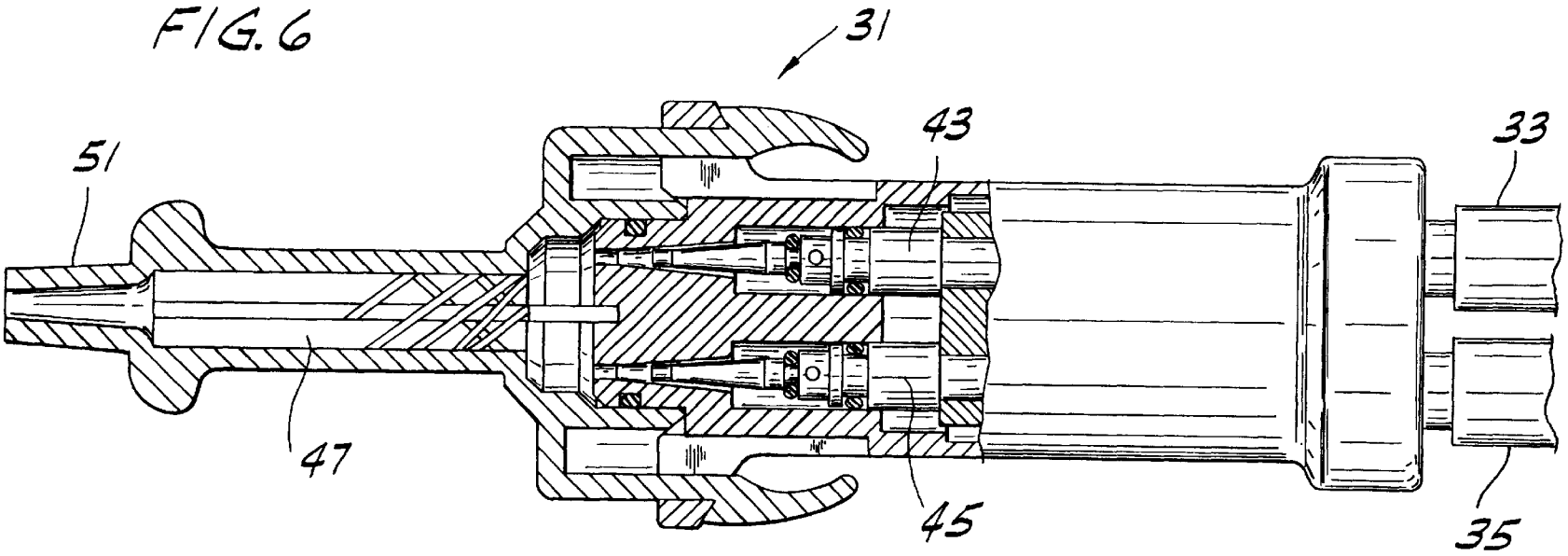
FIG. 6 is a top plan view of the injector of FIG. 4, parts of the injector being broken away to illustrate details.

The injection step can be carried out by using a suitable injector, such as a device 31 (FIGS. 5 and 6) similar to the foam dispensing gun described in U.S. Pat. No. 5,462,204, incorporated herein by reference. This device is particularly useful for dispensing two-component foaming fluids. In use, device 31 is connected via suitable lines 33, 35 to respective sources 37, 39 (e.g., portable pressurized tanks) of two separate pressurized components of the foaming fluid. The device 31 has an actuator 41 which is operated to open a pair of valves 43, 45, thereby allowing the two components to enter a mixing chamber 47 where they mix and are dispensed under pressure through a nozzle 51 at the front of the device. By holding the injector 31 so that the nozzle 51 is positioned in the gaps G or closely adjacent the gaps (within less than about one-half in.), the foaming fluid is injected under pressure directly into the gaps before it fully expands, as illustrated in FIG. 7. As a result, the foam expands while it is in the gaps G against the panels 13 and/or adjacent mine surfaces. The sealing material 25 is then allowed to set, resulting in an effective seal (FIG. 8.) Other types of injectors may be used, so long as they are capable of jetting a stream of sealant material directly into the aforementioned gaps G.

Whatever type of injector is used, it is preferable to hold the injector so that the stream of injected fluid is delivered at an angle (even if only slight) relative to the longitudinal axis of the gap G. This will ensure that the fluid strikes the panel and/or mine surfaces defining the gap and is deposited thereon, rather than passing straight through the gap and out the other side without impinging on such surfaces.

The sealing material 25 injected into the gaps G preferably has adhesive characteristics so that it adheres to the panel surfaces and mine surfaces after it has been injected into the gaps and allowed to set. This not only improves the seal between adjacent panel and mine surfaces, it also helps to increase the structural strength of the stopping 1. The strength of the stopping is further enhanced by applying (e.g., spraying) a fillet or line 55 of sealing material 25 along a major portion (and preferably 100%) of the periphery of the stopping to fill or at least cover the gaps between the stopping and the mine surfaces (see FIGS. 2, 3 and 4.)

Various sealing materials 25 can be used to carry out the injection method of the present invention. For example, foaming fluids of the type described above are believed to be generally suitable. One such material is a polyurethane foam having the following physical characteristics:

| | |
|---|---|
| Expansion Ratio | 6 fold |
| Compressive Strength | 16.7 psi parallel<br>11.3 psi perpendicular |
| Tensile Strength | 27.7 psi parallel<br>24.5 psi perpendicular |
| Cell structure | closed |
| Surface Formed | skin |

Other possible foaming fluids include phenolic foaming fluid and foamed portland or alumia cement. One foaming fluid which may be suitable is commercially available from RHH Foam Systems, Inc., located in Cudshy Wis., under the trade designation Versifoam.

Non-foaming expansive materials that have suitable expansion characteristics may also be used in the injection method of this invention. Alternatively, fluent materials such as concrete and grout may be used. The materials may also be settable (i.e., hardenable) or non-settable (i.e., permanently plastic). Whatever the material, it is important that it be applied by injection, not by spraying or some other non-injection method.

For best results, the sealing material 25 should provide a resiliently yielding seal. This will allow the seal to stretch and maintain its integrity during mine heaving and shifting, at least up to a point. Moreover, even if the sealing material does shear to some extent, it will continue to provide an effective seal because the sealing material has been injected into the gaps to fill them (at least partially), as compared to prior methods where the sealing material is applied so that it simply overlays (bridges) the gaps.

It will be observed from the foregoing that the method of this invention can be used to seal a stopping 1 in an effective and improved manner. The method is easy, requires less sealing material 25 than prior spraying techniques, provides a structurally stronger stopping 1, and results in a seal which is more likely to withstand a mine convergence. Also, since an injection method is used, less sealing material is introduced into the air to reduce environmental concerns.

The above method is applicable to new mine stoppings when they are installed. It is also applicable to old stoppings already in existence, although an old stopping may require some cleaning to remove any overlaying sealing material so that new sealant can be injected directly into the gaps.

The method of this invention is also applicable to mine stoppings other than those comprising a plurality of vertical panels 13. For example, the invention may also be used to seal masonry stoppings.

In view of the above, it will be seen that the several objects of the invention are achieved and other advantageous results attained.

As various changes could be made in the above methods without departing from the scope of the invention, it is intended that all matter contained in the above description or shown in the accompanying drawings shall be interpreted as illustrative and not in a limiting sense.

What is claimed is:

1. A method of sealing off a mine passageway, said method comprising:

installing a plurality of vertical interconnected panels side by side across the passageway to form a stopping, said interconnected panels being movable relative to one another to permit the stopping to accommodate mine heaving and shifting during a mine convergence without loss of structural integrity of the stopping, said stopping having gaps between adjacent panels and gaps between the panels and adjacent mine surfaces defining the mine passageway, holding an injector in or closely adjacent said gaps, and injecting a fluent sealing material under pressure into said gaps to form a seal.

2. A method as set forth in claim 1 wherein said sealing material is an expansible material, and wherein said method comprises injecting said expansible material into said gaps before it has fully expanded, said expansible material thereafter expanding in the gaps against adjacent panel surfaces and/or adjacent mine surfaces.

3. A method as set forth in claim 2 wherein said expansible material is a foaming fluid comprising two components, and wherein said method further comprises delivering said two components separate from one another to said injector, mixing said components in the injector to form the foaming fluid, and then injecting said foaming fluid under pressure into said gaps.

4. A method as set forth in claim 1 wherein said sealing material has adhesive characteristics for adhering to said panel surfaces and mine surfaces, said method further comprising allowing said sealing material to adhere to said panel surfaces and/or mine surfaces after it has been injected into said gaps.

5. A method as set forth in claim 4 wherein said sealing material is an expansible material, and wherein said method comprises injecting said expansible material into said gaps before it has fully expanded, said expansible material thereafter expanding in the gaps against adjacent panel surfaces and/or adjacent mine surfaces.

6. A method as set forth in claim 5 wherein said expansible material is a foaming fluid comprising two components, and wherein said method further comprises delivering said two components separate from one another to said injector, mixing said components in the injector to form the foaming fluid, and then injecting said foaming fluid under pressure into said gaps.

7. A method as set forth in claim 1 further comprising applying a fillet of said sealing material around at least a major portion of the perimeter of the stopping to seal gaps between the stopping and said mine surfaces.

8. A method of sealing a stopping installed in a mine passageway, said stopping having gaps therein and gaps between the stopping and adjacent mine surfaces defining the mine passageway, holding an injector in or within about one-half inch of said gaps, injecting a fluent sealing material under pressure into said gaps, and allowing the sealing material to form a yielding seal, said seal being yieldable under stress to maintain its integrity in the event of a mine convergence.

9. A method as set forth in claim 8 wherein said stopping is formed by installing a plurality of vertical panels side by side across the passageway, said stopping having gaps between adjacent panels and gaps between the panels and adjacent mine surfaces defining the mine passageway.

10. A method as set forth in claim 8 wherein said sealing material is an expansible material, and wherein said method comprises injecting said expansible material into said gaps before it has fully expanded, said expansible material thereafter expanding in the gaps against adjacent stopping surfaces and/or adjacent mine surfaces.

11. A method as set forth in claim 10 wherein said expansible material is a foaming fluid comprising two components, and wherein said method further comprises delivering said two components separate from one another to said injector, mixing said components in the injector to form the foaming fluid, and then injecting said foaming fluid under pressure into said gaps.

12. A method as set forth in claim 8 wherein said sealing material has adhesive characteristics for adhering to said stopping and mine surfaces, said method further comprising allowing said sealing material to adhere to said stopping and mine surfaces after it has been injected into said gaps.

13. A method as set forth in claim 12 wherein said sealing material is an expansible material, and wherein said method comprises injecting said expansible material into said gaps before it has fully expanded, said expansible material thereafter expanding in the gaps against adjacent stopping surfaces and/or adjacent mine surfaces.

14. A method as set forth in claim 13 wherein said expansible material is a foaming fluid comprising two components, and wherein said method further comprises delivering said two components separate from one another to said injector, mixing said components in the injector to form the foaming fluid, and then injecting said foaming fluid under pressure into said gaps.

15. A method as set forth in claim 8 further comprising applying a fillet of said sealing material around at least a major portion of the perimeter of the stopping to seal gaps between the stopping and said mine surfaces.

* * * * *

UNITED STATES PATENT AND TRADEMARK OFFICE

CERTIFICATE OF CORRECTION

PATENT NO. : 6,419,324 B1
DATED : July 16, 2002
INVENTOR(S) : William R. Kennedy et al.

It is certified that error appears in the above-identified patent and that said Letters Patent is hereby corrected as shown below:

Column 4,
Line 52, "holding an injector in or closely adjacent said gaps, and" should read -- holding an injector in or within about one-half inch of said gaps, --.
Line 54, "gaps to form a seal." should read -- gaps, and allowing the sealing material to form a yieldable seal, said seal being yieldable to maintain its integrity in the event the panels move relative to one another during said mine convergence --.

Signed and Sealed this

Twentieth Day of May, 2003

JAMES E. ROGAN
*Director of the United States Patent and Trademark Office*